US009260279B2

(12) United States Patent
Hoffend, III

(10) Patent No.: US 9,260,279 B2
(45) Date of Patent: Feb. 16, 2016

(54) LIFT ASSEMBLY WITH TAPERED DRUMS

(71) Applicant: Electronic Theatre Controls, Inc., Middleton, WI (US)

(72) Inventor: Donald A. Hoffend, III, Annandale, VA (US)

(73) Assignee: Electronic Theatre Controls, Inc., Middleton, WI (US)

( * ) Notice: Subject to any disclaimer, the term of this patent is extended or adjusted under 35 U.S.C. 154(b) by 182 days.

(21) Appl. No.: 14/087,059

(22) Filed: Nov. 22, 2013

(65) Prior Publication Data

US 2015/0144852 A1 May 28, 2015

(51) Int. Cl.

| | |
|---|---|
| ***B66D 1/26*** | (2006.01) |
| ***B66D 1/60*** | (2006.01) |
| ***A63J 1/02*** | (2006.01) |
| ***B66D 1/30*** | (2006.01) |
| ***B66D 1/39*** | (2006.01) |
| ***B66D 1/12*** | (2006.01) |

(52) U.S. Cl.

CPC ... *B66D 1/60* (2013.01); *A63J 1/02* (2013.01); *B66D 1/12* (2013.01); *B66D 1/30* (2013.01); *B66D 1/39* (2013.01)

(58) Field of Classification Search

CPC ..... B66D 1/26; B66D 1/34; B66D 3/08; B66D 1/12; B66D 1/60; B66D 2700/0166; B66D 2700/0175; B66D 2700/0183; A63J 1/02

See application file for complete search history.

(56) References Cited

U.S. PATENT DOCUMENTS

| | | | | |
|---|---|---|---|---|
| 977,500 | A | | 12/1910 | Bailey |
| 1,027,027 | A | | 5/1912 | Bailey |
| 1,668,880 | A | | 5/1928 | Vallen |
| 1,831,128 | A | | 11/1931 | McKenny et al. |
| 2,142,063 | A | | 12/1938 | Tompkins |
| 2,227,043 | A | | 12/1940 | Tompkins |
| 2,513,095 | A | * | 6/1950 | Hunt ..... 226/194 |
| 2,589,172 | A | | 3/1952 | Wagner |
| 2,857,137 | A | * | 10/1958 | Fillion ..... 254/318 |
| 2,942,879 | A | | 6/1960 | Izenour |
| 4,303,237 | A | | 12/1981 | Hoffend et al. |
| 5,072,840 | A | | 12/1991 | Asakawa et al. |

(Continued)

FOREIGN PATENT DOCUMENTS

| | | |
|---|---|---|
| DE | 937975 | 1/1956 |
| DE | 1425058 | 2/1969 |
| GB | 178580 | 4/1911 |

OTHER PUBLICATIONS

International Search Report for Application No. PCT/US2014/066507 dated Feb. 6, 2015 (4 pages).

(Continued)

*Primary Examiner* — Emmanuel M Marcelo

(74) *Attorney, Agent, or Firm* — Michael Best & Friedrich LLP

(57) ABSTRACT

A lift assembly including a base, a drive mechanism, and a drum assembly adapted to be driven by the drive mechanism. The drum assembly includes first and second drum segments positioned adjacent each other, each drum segment including a small diameter portion, a large diameter portion, and a tapered portion between the small diameter portion and the large diameter portion. The lift assembly further includes first and second flexible drive elements at least partially wrapped around the small diameter portions of the first and second drum segments, respectively.

20 Claims, 7 Drawing Sheets

(56) References Cited

U.S. PATENT DOCUMENTS

| | | | | |
|---|---|---|---|---|
| 5,106,057 | A * | 4/1992 | Feller et al. | 254/334 |
| 5,361,565 | A | 11/1994 | Bayer et al. | |
| 6,520,485 | B1 | 2/2003 | Soot | |
| 6,537,155 | B2 | 3/2003 | Steve et al. | |
| 7,766,308 | B2 | 8/2010 | Kochan et al. | |
| 7,810,792 | B2 | 10/2010 | Hoffend et al. | |
| 8,002,243 | B2 | 8/2011 | Murphy et al. | |
| 2004/0238804 | A1 | 12/2004 | Revi | |
| 2008/0168981 | A1 | 7/2008 | Cummings et al. | |
| 2010/0140435 | A1 | 6/2010 | van der Meer | |
| 2011/0042634 | A1 | 2/2011 | Boychuk | |
| 2012/0025157 | A1 | 2/2012 | Hoffend, III | |
| 2012/0298937 | A1 | 11/2012 | Fisher | |
| 2013/0001488 | A1 | 1/2013 | Hoffend et al. | |
| 2013/0015315 | A1 | 1/2013 | Hoffend, III et al. | |
| 2013/0043449 | A1 | 2/2013 | Hoffend et al. | |

OTHER PUBLICATIONS

International Written Opinion for Application No. PCT/US2014/066507 dated Feb. 6, 2015 (6 pages).

* cited by examiner

LIFT ASSEMBLY WITH TAPERED DRUMS

BACKGROUND

The present invention relates generally to lift assemblies, such as those used to raise and lower scenery, props, and lighting on a stage.

SUMMARY

In one embodiment, the invention provides a lift assembly including a base, a drive mechanism, and a drum assembly adapted to be driven by the drive mechanism. The drum assembly includes first and second drum segments positioned adjacent each other, each drum segment including a small diameter portion, a large diameter portion, and a tapered portion between the small diameter portion and the large diameter portion. The lift assembly further includes first and second flexible drive elements at least partially wrapped around the small diameter portions of the first and second drum segments, respectively.

In another embodiment the invention provides a method of operating a lift assembly having first and second drum segments positioned adjacent each other and first and second flexible drive elements coupled to the first and second drum segments, respectively. The method includes wrapping the first and second flexible elements around the first and second drum segments, respectively, continuing to wrap the first flexible element around the first drum segment multiple times until the first flexible element reaches an end of the first drum segment adjacent the second drum segment, and overlapping the first flexible drive element onto the second flexible drive element.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

Figure 1:
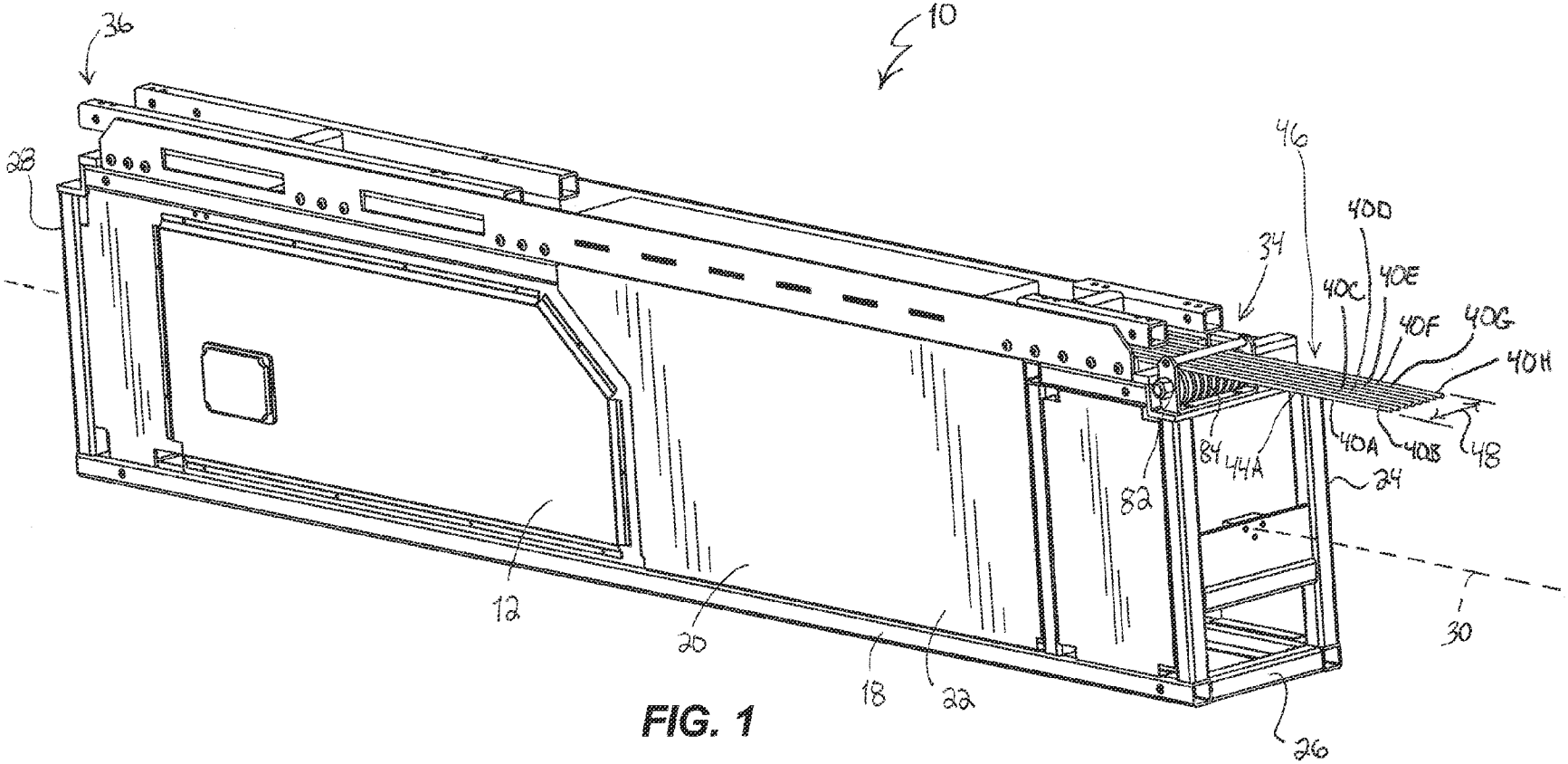
FIG. 1 is a perspective view of a lift assembly according to one embodiment of the invention.
Figure 2:
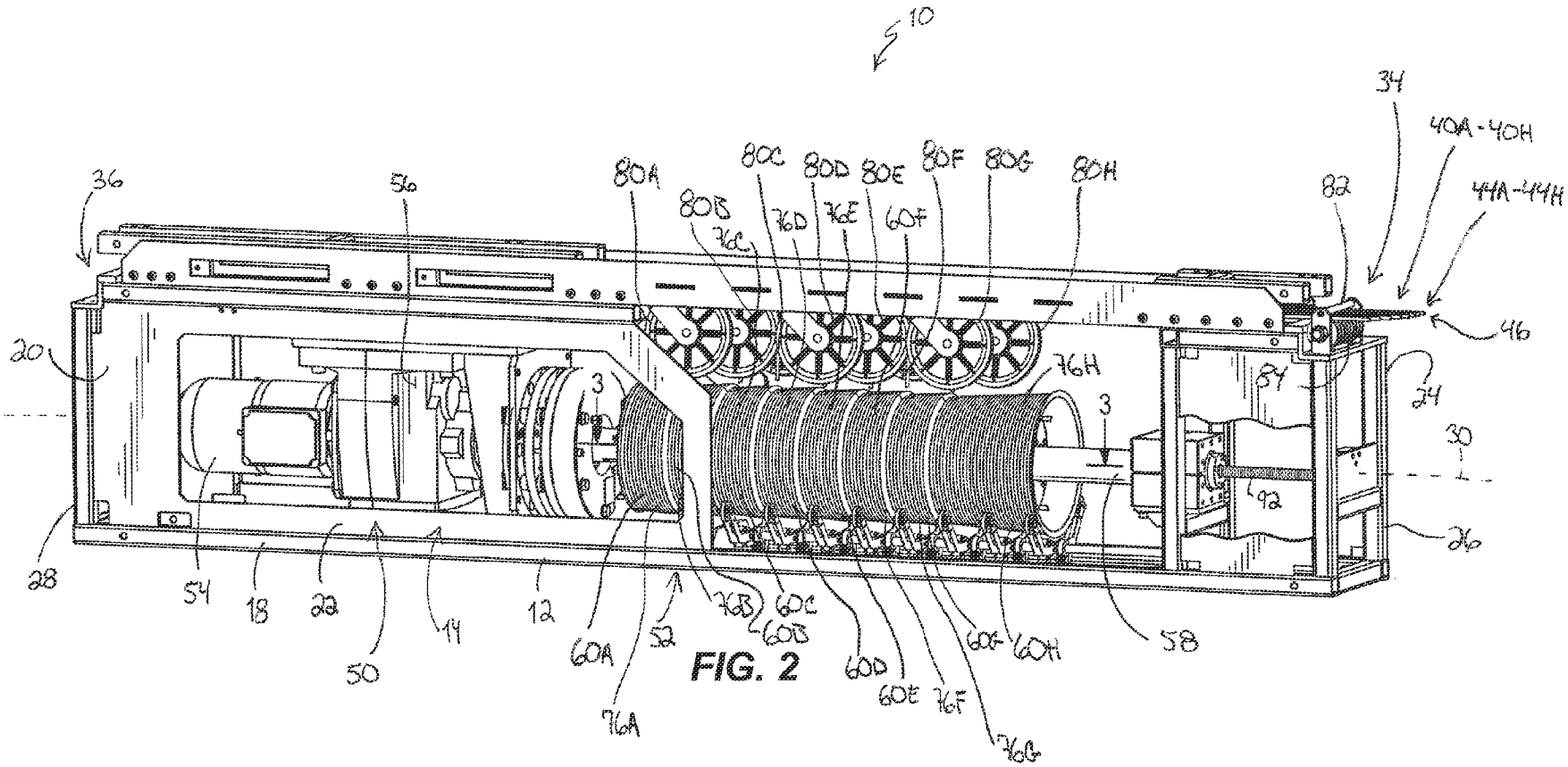
FIG. 2 is an alternative perspective view of the lift assembly of FIG. 1 with side panels of the lift assembly removed.

FIGS. 1-2 illustrate a lift assembly 10 including a base 12 and a take-up mechanism 14 that is mounted to the base 12. The base 12 includes a frame 18 and side panels 20 that are secured to the frame 18. The frame 18 provides a stable location for mounting the various internal components of the assembly 10, and the panels 20 provide a barrier for inhibiting contamination of and unauthorized access to the internal components and the panels 20 can also be sound deadening panels.

The base 12 further includes a first side 22, a second side 24, a first end 26, and a second end 28 that are defined by the frame 18 and the panels 20. The first side 22 and the second side 24 are parallel and face opposite directions and the first end 26 and the second end 28 are parallel and face opposite directions. The first and second sides 22, 24 extend along the length of the assembly 10 and a longitudinal axis or centerline 30 of the assembly 10 extends midway between the sides 22, 24 and bisecting the ends 26, 28. A length or longitudinal extent of the assembly 10 is the distance from the first end 26 to the second end 28 along the axis 30.

The base 12 further includes a first outlet 34 and a second outlet 36, the purpose of which will be discussed in more detail below. The first outlet 34 is located through the first end 26 of the base 12 and is positioned closer to the first side 22 than to the second side 24. Alternatively stated, the first outlet 34 is offset from the centerline 30 toward the first side 22 of the base 12. The second outlet 36 is located through the second end 28 of the base 12 and is positioned closer to the first side 22 of the base 12 than the second side 24. Similar to the first outlet 34, the second outlet 36 is offset from the centerline 30 toward the first side 22 of the base 12.

Figure 3:
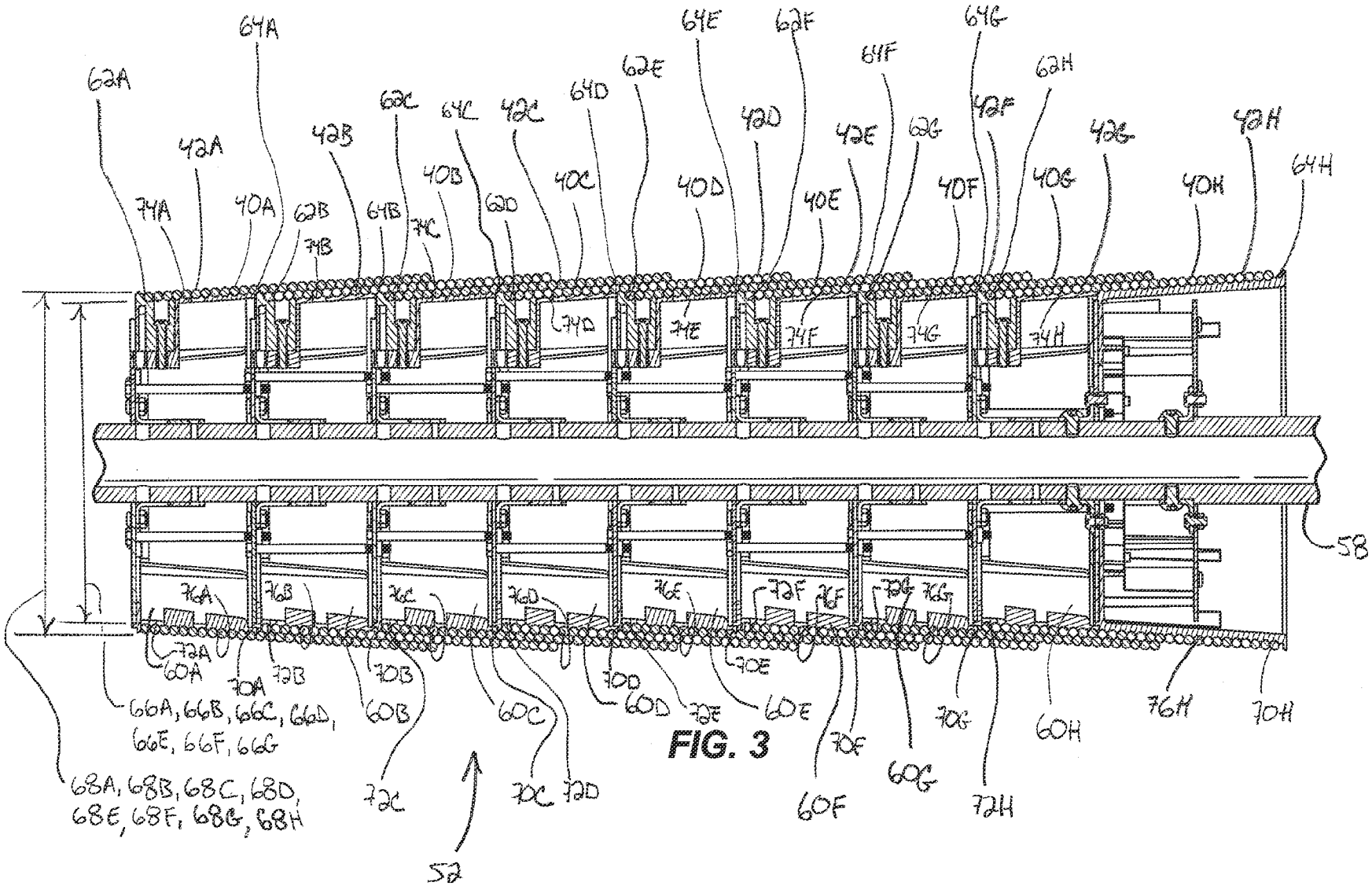
FIG. 3 is a cross-sectional view of a portion of the lift assembly of FIG. 1 taken along lines 3-3 of FIG. 2.

Referring to FIGS. 1 and 3, the lift assembly 10 further includes flexible drive elements 40A-40H. Each of the flexible drive elements 40A-40H is essentially the same (the only difference being their respective length), and only one flexible drive element 40A will be described in detail. Like portions of the drive elements 40A-40H have been give the same reference number with the suffix A-H, respectively. The flexible drive element 40A includes a stored portion 42A that is on the take-up mechanism 14 and a free portion 44A that extends from the take-up mechanism 14 through the outlet 34. The free portion 44A that extends through the outlet 34 is closer to the first side 22 of the base 12 than to the second side 24. That is, the free portion 44A is offset from the centerline 30 of the base 12 is a direction toward the first side 22. Together the flexible drive elements 40A-40H extend through the outlet 34 to define a cable path 46 having a cable path width 48 (see FIG. 4). The cable path 46 is offset from the centerline 30 of the base 12 in a direction toward the first side 22. In the illustrated embodiment, the entire cable path 46 (i.e., all of the flexible drive elements 40A-40H) exiting the outlet 34 is located between the first side 22 and the centerline 30. In other embodiments, a portion of the cable path 46 can be on the other side of the centerline 30 (i.e., between the centerline 30 and the second side 24). Also, in the illustrated embodiment, all of the flexible drive elements 40A-40H in the cable path are flush in a direction perpendicular to the cable path 46, such that the cable path 46 is flat and the flexible drive elements 40A-40H are co-planar. In the illustrated embodiment, the flexible drive elements 40A-40H are cables, such as a twisted wire cables with multiple strands, but in other embodiment, other suitable flexible drive elements may be utilized, such as, chains, ropes, and the like.

Figure 5:
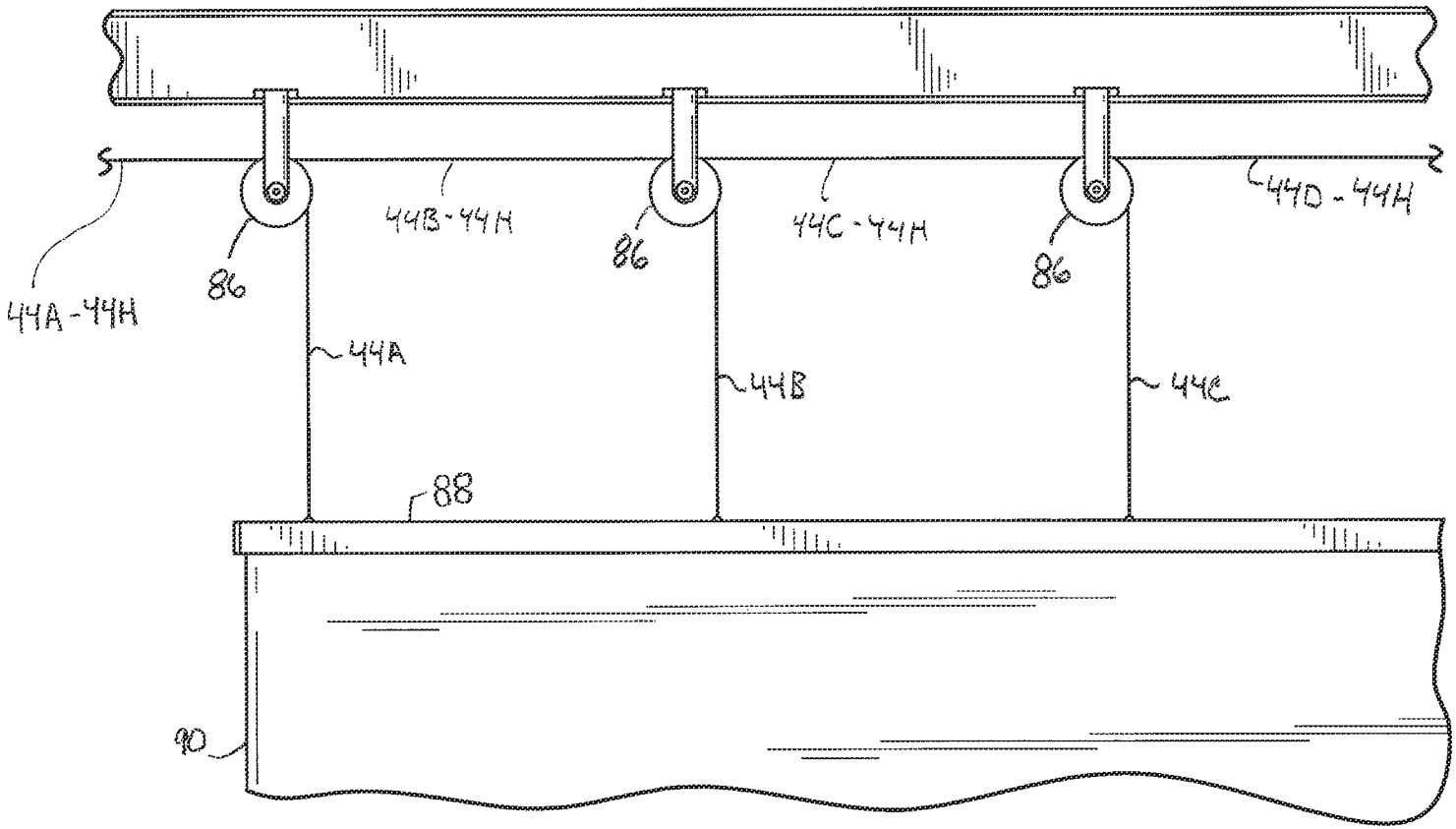
FIG. 5 illustrates one application of the lift assembly of FIG. 1.

As illustrated in FIG. 5, in one application of the lift assembly 10, the free portions 44A-44H of the flexible drive elements 40A-40H are routed to loft blocks 86 that change the direction of the flexible drive elements 40A-40H and then routed to a batten 88 or the like to raise and lower an article 90 such as scenery, props, and lighting on a stage.

Referring to FIG. 2, the take-up mechanism 14 includes a drive mechanism 50 and a drum assembly 52. The drive mechanism 50 includes an electric motor 54, a transmission 56, and a drive shaft 58. The transmission connects the motor 54 and the drive shaft 58 such that operation of the motor 54 rotates the drive shaft 58 in the clockwise and counterclockwise directions. The drum assembly 52 is coupled to the drive shaft 58, such that rotation of the drive shaft 58 by the motor 54 rotates the drum assembly 52 in the clockwise and counterclockwise directions. In the illustrated embodiment, the drum 52 and the drive shaft 58 move axially along the longitudinal axis 30 of the base 12, the purpose of which will discussed in more detail below.

Figure 4:
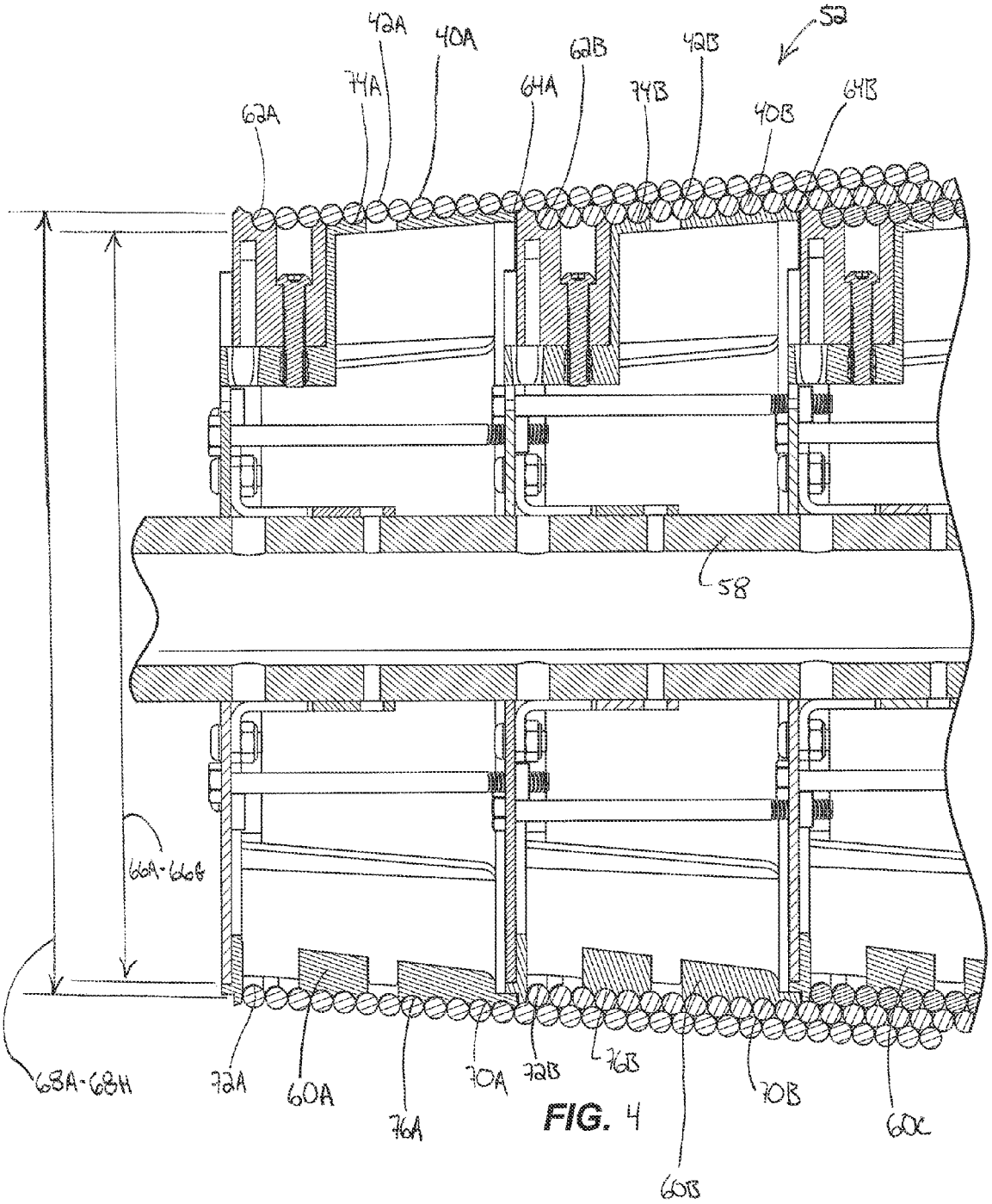
FIG. 4 is an enlarged view of a portion of FIG. 3

Referring to FIGS. 3 and 4, the drum assembly 52 includes drum segments 60A-60H. The drum segments 60A-60H correspond to the flexible drive elements 40A-40H. That is, the flexible drive element 40A winds around drum segment 60A, the flexible drive element 40B winds around drum segment 60B, etc. The drum segments 60A-60H are substantially the same and like components have been given like reference numbers with the suffix A-H, which corresponds to the drum segments 60A-60H. The drum segment 60A includes a first end 62A and a second end 64A. The first end 62A has a diameter 66A and the second end 64A has a diameter 68A that is larger than the diameter 66A. The diameter of the drum segment 60A constantly increases from the first end 62A to the second end 64A. Therefore, a large diameter portion 70A of the drum segment 60A is located adjacent the second end 64A, a small diameter portion 72A is located adjacent the first end 62A, and a tapered portion 74A is located between the small diameter portion 72A and the large diameter portion 70A.

The drum segments 60A-60H are coupled to the drive shaft 58 as best seen in FIG. 3. The first end 62B of the second drum segment 60B having the small diameter 66B abuts the second end 64A of the first drum segment 60A having the large diameter 68A. Likewise, the first end 62C of the third drum segment 60C having the small diameter 66B abuts the second end 64B of the second drum segment 60B having the large diameter 68B. The remainder of the drum segments 60D-60H are similarly arranged along the drive shaft 58.

The drum segments 60A-60H all includes grooves 76A-76H, respectively, that extend circumferentially around the drum segments 60A-60H. The grooves 76A-76H receive the respective flexible drive elements 40A-40H to facilitate winding the flexible drive elements 40A-40H around the drum assembly 52.

Referring to FIG. 2, the lift assembly further includes internal sheaves 80A-80H. The internal sheave 80A corresponds to the drum segment 60A and the flexible drive element 40A, the internal sheave 80B corresponds to the drum segment 60B and the flexible drive element 40B, etc. The sheaves 80A-80H direct the corresponding flexible drive element 40A-40H from the corresponding drum segment 60A-60H to the outlet 34. A head block 82 is located adjacent the outlet 34. The head block 82 includes a plurality of rollers 84 that guide the flexible drive elements 40A-40H. In the illustrated embodiment, the internal sheaves 80A-80H can be configured to route the flexible drive elements 80A-80H through the first outlet 34 and the second outlet 36. When any of the flexible drive elements 80A-80H are routed through the second outlet 36 a second head block, similar to head block 82, would be located adjacent the second outlet 36.

With continued reference to FIG. 2, the illustrated lift assembly 10 includes a threaded rod 92 located at an end of the shaft 58. The rod 92 is fixed relative to the frame 18. The shaft 58 is generally hollow and the threaded rob 92 is received in a threaded recess of the shaft 58. As the shaft 58 rotates relative to the rod 92 (which is fixed relative to the frame 18) the shaft 58 and drum assembly 52 (which is fixed relative to the shaft 58) move relative to the internal sheaves 80A-80H along the longitudinal axis 30 to facilitate winding and unwinding the flexible drive elements 40A-40H around the drum assembly 52.

In operation, the motor 54 rotates the drive shaft 58 to wind and unwind the flexible drive elements 40A-40H around the drum assembly 52 to raise and lower the free portions 44A-44H of the flexible drive elements 40A-40H, which raises and lowers an article, such as scenery, props, lighting, and the like that are attached to the free portions 44A-44H. As best seen in FIG. 3, when raising the article, the flexible drive elements 40A-40H wrap around the corresponding drum segment 60A-60H in the corresponding grooves 76A-76H. The first flexible drive element 40A starts wrapping around the segment 60A in the grooves 76A in the small diameter portion 72A of the segment 60A. Meanwhile, the second flexible drive element 40B starts wrapping around the drum segment 60B in the grooves 76B in the small diameter portion 72B of the drum segment 60B. The additional flexible drive elements 40C-40H likewise wrap around the corresponding drum segments 60C-60H.

The flexible drive element 40B is wrapped onto the small diameter portion 72B of the drum segment 60B to define an outer profile or outer diameter that is substantially flush with the large diameter portion 70A of the drum segment 60A. As the flexible drive element 40A continues to wind onto the drum segment 60A, the additional stored portion 42A moves in a direction toward the drum segment 60B because the drum assembly 52 moves relative to the frame 18 along the longitudinal axis 30. Eventually, the flexible drive element 40A wraps around the drum segment 60A until it reaches the second end 64A of the drum segment 60A, and as the flexible drive element 40A continues to wind around the drum assembly 52, the flexible drive element 40A overlaps onto the outer profile created by the flexible drive element 40B. As discussed above, the outer profile of the drive element 40B is flush with the second end 64A of the drum segment 60A, and therefore the drive element 40A smoothly transitions from wrapping around the segment 60A and onto the segment 60B. As illustrated in FIG. 3, the other flexible drive elements 40B-40G similarly overlap onto the adjacent drum segment 60B-60G. Because segment 60H is the final drum segment there is no adjacent segment for drive element 40H to wrap onto and around. Therefore, drum segment 60H is longer and has a longer tapered portion 74H than the other drum segments 60A-60G.

Figure 6:
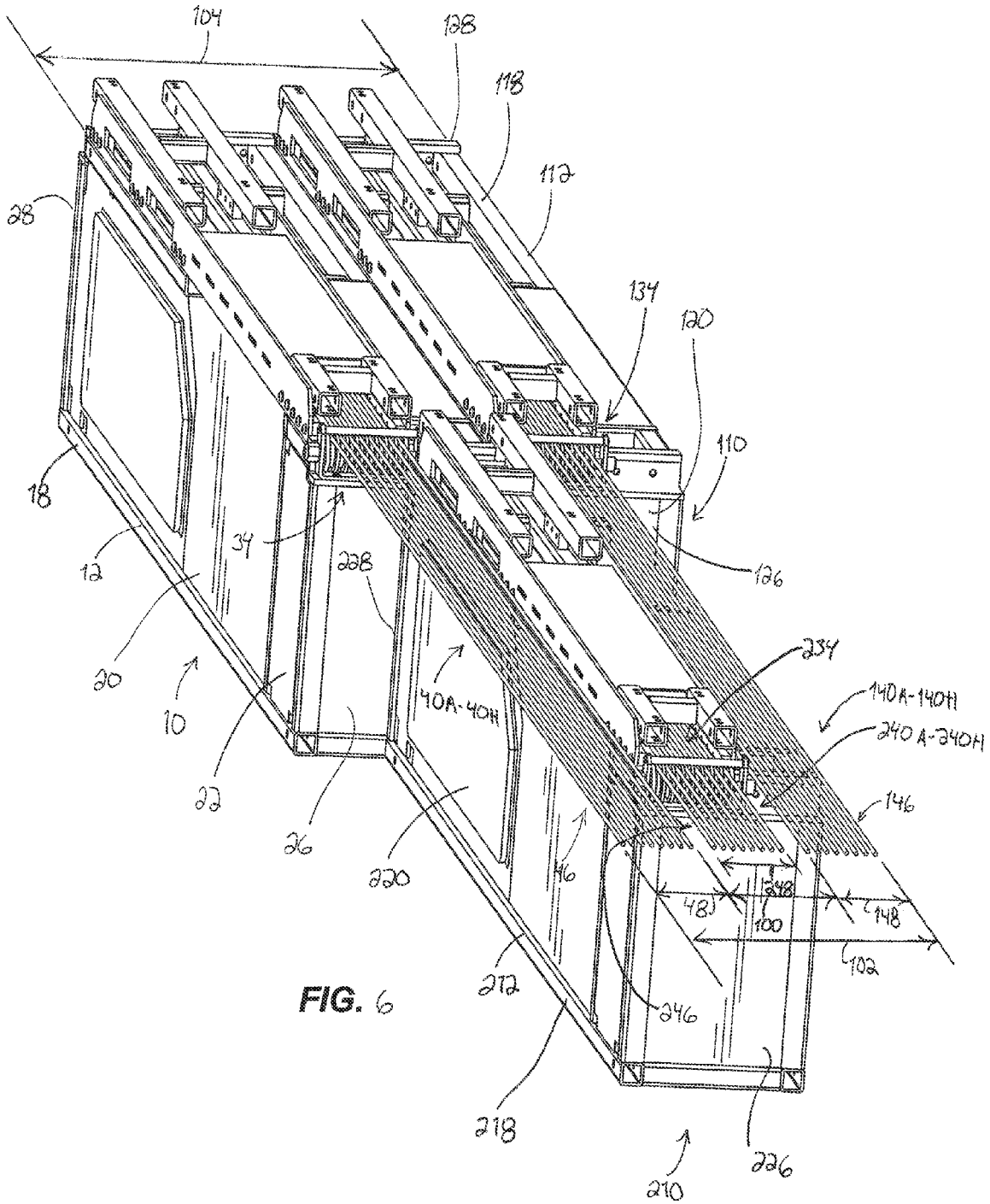
FIG. 6 is a perspective view of multiple lift assemblies of FIG. 1 in a nested configuration according to another embodiment of the invention.
Figure 7:
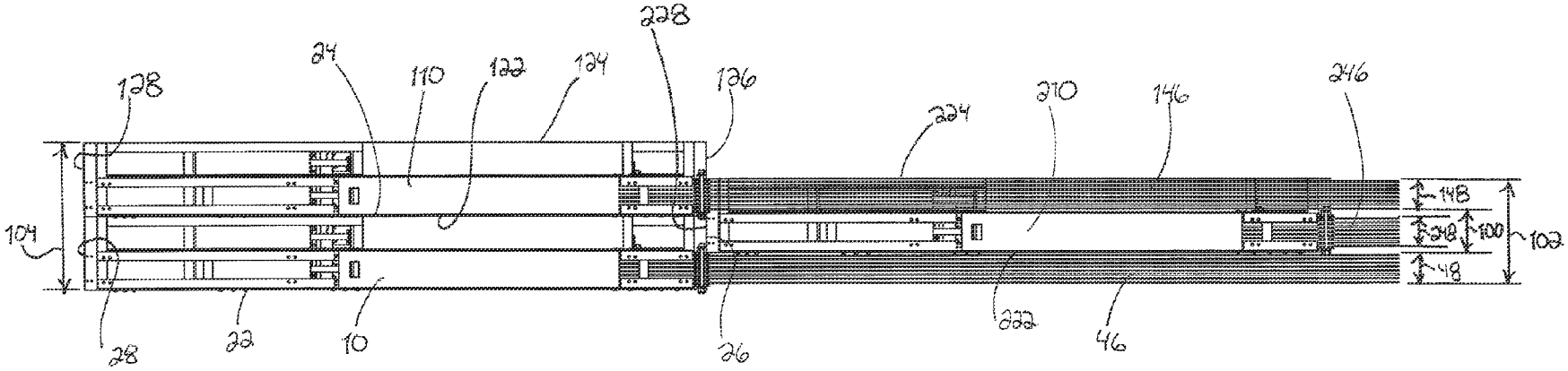
FIG. 7 is a top view of the nested lift assemblies of FIG. 4.

As illustrated in FIGS. 6 and 7, multiple lift assemblies 10, 110, and 210 can be mounted adjacent to each other and together the lift assemblies 10, 110, 210 can be mounted to a structure, such as a ceiling, a floor, walls, or other suitably stable component. Each of the illustrated lift assemblies 10, 110, and 210 is structurally identical to the other lift assemblies 10, 110, and 210 and identical to the lift assembly 10 described above with regard to FIGS. 1-3 and therefore like components have been given like reference numbers plus 100. Each has lift assembly 10, 110, and 210 has its own position or orientation, as described below in more detail.

With continued reference to FIGS. 6 and 7, the second side 24 of the first lift assembly 10 is positioned adjacent the first side 122 of the second lift assembly 110. In the illustrated embodiment, the second side 24 of the lift assembly 10 abuts the first side 122 of the lift assembly 110. Also, the ends 26, 126 and 28, 128 are aligned and flush as illustrated. Therefore, the cable path 46 and the cable path 146 extend in the same direction and are parallel. As illustrated in FIGS. 6 and 7, the cable path 46 exiting the base 12 of the first lift assembly 10 is spaced a distance 100 from the cable path 146 exiting the base 112 of the second lift assembly 110.

The second end 228 of the base 212 of the third lift assembly 210 abuts the first end 26 of the first lift assembly 10 and the first end 126 of the second lift assembly 110 to define a pyramid arrangement with the third lift assembly 210 forming a peak of the pyramid. The third lift assembly 210 is positioned so that the cable path 246 is between in the cable paths 46, 146 and located in the space 100. The cable path 246 extends in the same direction as the cable paths 46, 146 and parallel to the paths 46, 146 and the cable paths 46, 146, 246 are co-planar. Together the cable paths 46, 146, 246 define a total cable path width 102. In the illustrated embodiment that includes three lift assemblies 10, 110, 210, the total cable path width 102 is only about 3.6 times greater than the width 48 of a single cable path 48, 148, 248. In other embodiments, the total cable path width is between about 3.3 to 3.9 times greater than the width of a single cable path. In yet other embodiments, the total cable path width is between about 3.1 to 4.1 times greater than the width of a single cable path.

The base 12 of the first lift assembly 10 and the base 112 of the second lift assembly 110 are side-by-side to define a total width 104 (FIG. 7) of the group of lift assemblies 10, 110, and 210. The total cable path width 102 is less than the width 104 of the group of lift assemblies 10, 110, 210. In some embodiments, the total cable path width 102 is less than 80 percent of the width 104, and in yet other embodiments, the total cable path width 102 is less than 95 percent of the width 104.

The first, second, and third lift assemblies 10, 110, 210 can be coupled using any suitable fastener or method such as bolts, welding, and the like. Also, although the illustrated third lift assembly 210 abuts both ends 26, 126 of the lift assemblies 10, 110, respectively, in other embodiments, the end 226 of the third lift assembly 210 may abut only one of the ends 26, 126.

The nested arrangement of the lift assemblies 10, 110, 210, described above, reduces the total cable path width 102 (compared to positioning the three lift assemblies In a side-by-side orientation). Reducing the total cable path width 102 is desirable because it reduces the distance required between articles lifted by the lift assemblies 10, 110, 210. Or, if the lift assemblies 10, 110, 210 are lifting the same article, the distance between all the flexible drive elements 40, 140, 240 is reduced, which reduces the horizontal spacing required between any loft blocks that redirect the flexible drive elements 40, 140, 240 down to the article being raised and lowered.

Various features and advantages of the invention are set forth in the following claims.

What is claimed is:

1. A lift assembly comprising:

a base;

a drive mechanism;

a drum assembly adapted to be driven by the drive mechanism, the drum assembly including first and second drum segments positioned adjacent each other, each drum segment including a small diameter portion, a large diameter portion, and a tapered portion between the small diameter portion and the large diameter portion; and first and second flexible drive elements at least partially wrapped around the small diameter portions of the first and second drum segments, respectively;

wherein the large diameter portion of the first drum segment abuts the small diameter portion of the second drum segment.

2. A lift assembly as claimed in claim 1, wherein the base comprises a housing.

3. A lift assembly as claimed in claim 2, wherein the housing comprises a frame.

4. A lift assembly as claimed in claim 1, wherein the drive mechanism comprises an electric motor.

5. A lift assembly as claimed in claim 1, wherein a second wrapped portion of the second flexible element is at least partially wrapped onto the small diameter portion of the second drum segment to define an outer profile of the second wrapped portion that is substantially flush with the large diameter portion of the first drum segment.

6. A lift assembly as claimed in claim 5, wherein the first flexible element is wrapped multiple times onto the first drum segment and also overlapped onto the second flexible element.

7. A lift assembly as claimed in claim 1, wherein the lift assembly includes more than two drum segments and more than two flexible drive elements.

8. A lift assembly as claimed in claim 1, wherein the flexible drive elements comprise cables.

9. The lift assembly of claim 1, wherein the drum assembly is rotatable about an axis.

10. The lift assembly of claim 9, wherein the drive mechanism includes a drive shaft extending through the drum assembly and rotatable about the axis.

11. The lift assembly of claim 1, further comprising a first sheave coupled to the base, the first sheave directing the first flexible drive element from the drive mechanism to the first drum segment.

12. The lift assembly of claim 11, wherein the drum assembly moves relative to the base such that the first sheave directs the first flexible drive element to be wrapped around the first and second drum segments.

13. The lift assembly of claim 11, further comprising a second sheave coupled to the base, the second sheave directing the second flexible drive element from the drive mechanism to the second drum segment.

14. A method of operating a lift assembly having first and second drum segments positioned adjacent each other and first and second flexible drive elements coupled to the first and second drum segments, respectively, the method comprising:

wrapping the first and second flexible elements around the first and second drum segments, respectively;

continuing to wrap the first flexible element around the first drum segment multiple times until the first flexible element reaches an end of the first drum segment adjacent the second drum segment; and overlapping the first flexible drive element onto the second flexible drive element.

15. A method of operating a lift assembly as claimed in claim 14, wherein wrapping includes wrapping the second flexible element around the second drum segment multiple times to define an outer profile of the second wrapped portion that is substantially flush with the first drum segment.

16. A method of operating a lift assembly as claimed in claim 14, wherein wrapping includes wrapping more than two flexible drive elements around more than two drum segments, respectively.

17. A method of operating a lift assembly as claimed in claim 14, wherein the flexible drive elements comprise cables.

18. A method of operating a lift assembly as claimed in claim 14, wherein each drum segment includes a small diameter portion, a large diameter portion, and a tapered section between the small diameter portion and the large diameter portion, and wherein wrapping includes wrapping the second flexible element into the small diameter portion and tapered portion of the second drum segment multiple times to define a wrapped portion of the second flexible element.

19. A method of operating a lift assembly as claimed in claim 18, wherein the second wrapped portion of the second flexible element is substantially flush with the large diameter portion of the first drum segment.

20. A method of operating a lift assembly as claimed in claim 18, wherein overlapping includes wrapping the first flexible element onto the wrapped portion of the second flexible element.

* * * * *